US005507357A

United States Patent [19]

Hult et al.

[11] Patent Number: 5,507,357

[45] Date of Patent: Apr. 16, 1996

[54] PILOT BIT FOR USE IN AUGER BIT ASSEMBLY

[75] Inventors: Vern Hult; Kare Asak, both of Calgary, Canada

[73] Assignee: Foremost Industries, Inc., Canada

[21] Appl. No.: 379,357

[22] Filed: Jan. 27, 1995

[30] Foreign Application Priority Data

Feb. 4, 1994 [CA] Canada ..... 2115004

[51] Int. Cl.[6] ..... E21B 10/26; E21B 10/44; E21B 25/02

[52] U.S. Cl. ..... 175/385; 175/394

[58] Field of Search ..... 175/385, 386, 175/334, 335, 394; 299/87.1

[56] References Cited

U.S. PATENT DOCUMENTS

| | | | |
|---|---|---|---|
| 2,054,255 | 9/1936 | Howard | 175/298 |
| 3,095,051 | 6/1963 | Robinsky et al. | 175/394 X |
| 3,924,697 | 12/1975 | College | 175/382 |
| 4,248,313 | 2/1981 | Bonca | 175/394 X |
| 4,667,754 | 5/1987 | Diedrich | 175/394 X |
| 5,158,147 | 10/1992 | Pavey et al. | 175/385 |

FOREIGN PATENT DOCUMENTS

| | | |
|---|---|---|
| 346576 | 12/1934 | Canada . |
| 653583 | 12/1962 | Canada . |
| 1064467 | 10/1979 | Canada . |
| 2065143 | 4/1992 | Canada . |

*Primary Examiner*—David J. Bagnell
*Attorney, Agent, or Firm*—Hayes, Soloway, Hennessey, Grossman & Hage

[57] ABSTRACT

A pilot bit for use with an auger bit in an auger bit assembly secured to the downhole end of tubular drill stem for drilling boreholes in earth formations comprises a tubular pilot bit body having a downhole end and an upper end at the axially opposite end of the body, the body being dimensioned to be telescopically received within an axial bore of an auger bit and being releasably connectable to the auger bit against axial and angular displacement, an axial throughbore extending through the body for telescopically receiving an earth sampling tool, a closure device secured to the downhole end of the pilot bit for opening and closing the throughbore, and pilot bit cutting teeth secured to the closure device. The closure device is movable between an open position removed from the throughbore to permit passage of a sampling tool through the pilot bit into an earth formation and a closed position whereat the closure device seals the throughbore and the pilot bit cutting teeth are disposed for cutting into an earth formation upon rotation of the pilot bit.

13 Claims, 9 Drawing Sheets

PILOT BIT FOR USE IN AUGER BIT ASSEMBLY

The present invention generally relates to an auger bit assembly used for drilling in earth formations and, more specifically, to a pilot bit for an auger bit assembly which allows soil samples to be taken without removing the pilot bit from the auger bit assembly.

BACKGROUND OF THE INVENTION

The use of hollow stem augers to take samples of soil in undisturbed soil is well known in the art. The apparatus includes a hollow stem formed by a series of pipes connected together in end-to-end relation and an inner drill rod also in the form of a series of pipes connected together in end-to-end relation. The inner drill rod is telescopically inserted into the hollow stem. Both the hollow stem and the inner drill rod are provided with cutting bits on their respective lower ends for cutting a hole in an earth formation as the apparatus is rotated by a drive mechanism located at the surface. The cutting bit secured to the inner drill rod is keyed to the cutting bit secured to the hollow stem so that both cutting bits rotate in unison. An auger is secured to the outer surface of the hollow stem for carrying cuttings to the surface.

Once the hole has been drilled to the desired depth, casing pipes can be placed in the hole to form a well wall and a gravel pack is installed around the casing pipes. Typically, the inner drill string is removed once the desired depth is achieved to allow working inside the outer casing with coring tools, soil sampling equipment, in-hole hammers, environmental monitoring equipment and other apparatus well known in the art.

Soil samples are taken every few feet during the drilling process. Heretofore, this has been achieved by telescopically removing and dismantling the entire inner drill rod from the hollow stem, inserting a soil sampling tool into the hollow stem and lowering the tool the bottom, taking a soil sample, extracting the sampling tube with its soil sample, re-assembling and lowering the inner drill rod into the hollow stem, drilling a few more feet and then repeating the process. Clearly, this has been a time consuming process, particularly when the bore hole is several hundred feet in depth. This arrangement also suffers from the disadvantage that, with the removal of the prior art pilot bit, there is nothing to prevent formation heaving, that is, sand flowing into the auger bit and beyond as a result of differential pressures and water flow. Severe instances of formation heaving can prevent re-installation of the pilot bit. Notwithstanding these disadvantages, the above-described auger bit assembly provides sufficient advantages to warrant continuing with its relatively widespread use. There is clearly a need for an apparatus which will speed up the soil sampling process.

SUMMARY OF THE INVENTION

The present invention seeks to provide a latchable pilot bit for use in an auger bit assembly which seals the interior of the auger bit assembly from the earth formation but which will allow a sampling device to pass through the pilot bit to collect soil samples, then re-seal when the sampling tool is withdrawn. Once the borehole has been drilled to the desired depth, the pilot bit can be unlatched and withdrawn to allow the well to be completed. Upon withdrawal of the pilot bit, the inside diameter at the bottom of the auger should be virtually unrestricted.

The pilot bit is provided with a passage which is approximately equal to the diameter of the sampling tool through which the sampling tool travels before the pilot bit opens. Thus, since the sampling tool is already in the passage before the pilot bit opens, the formation cannot heave due to water flow into the inside of the auger bit when the pilot bit opens. The advantage of this arrangement is that the sampling tool need only to be pushed through the pilot bit to collect a sample, whereas, as already mentioned, the prior art pilot bit had to be withdrawn and re-installed after sampling. Clearly, the present invention provides faster sampling due to less trips in and out of the borehole and eliminates the problem of sand heaving into the auger which can prevent reinstallation of the pilot bit.

In addition, the pilot bit is constructed in such a manner as to wipe clay and soil from the outside of the sampling tool as the latter is retracted from the pilot bit thus keeping the interior of the pilot bit clear of extra soil which could cause problems with the bit re-closing and re-sealing. In the preferred embodiment of the invention, the pilot bit is provided with a two part pivoted closure arrangement which is constructed in such a manner as to require only a 45° tilt of the closure members when the sampling tool passing through the closure arrangement. This prevents crowding of the borehole wall.

In summary, the present invention provides a pilot bit for use with an auger bit in an auger bit assembly secured to the downhole end of tubular drill stem for drilling boreholes in earth formations, the pilot bit comprising a tubular pilot bit body having a downhole end and an upper end at the axially opposite end of the body, the body being dimensioned to be telescopically received within an axial bore of an auger bit and being releasably connectable to the auger bit against axial and angular displacement, an axial throughbore extending through the body for telescopically receiving an earth sampling tool, closure means secured to the downhole end of the pilot bit for opening and closing the throughbore, and pilot bit cutting teeth secured to the closure means, the closure means being movable between an open position removed from the throughbore to permit passage of a sampling tool through the pilot bit into an earth formation and a closed position whereat closure means seals the throughbore and the pilot bit cutting teeth are disposed for cutting into an earth formation upon rotation of the pilot bit.

BRIEF DESCRIPTION OF THE DRAWINGS

These and other features of the invention will become more apparent from the following description in which reference is made to the appended drawings wherein:

FIG. 1*a* is a broken cross-sectional view through a portion of the upper reduced diameter portion of the auger bit and the bottom end of a drill pipe to illustrate one manner in which the two members can be secured together;

DESCRIPTION OF PREFERRED EMBODIMENT

Figure 1:
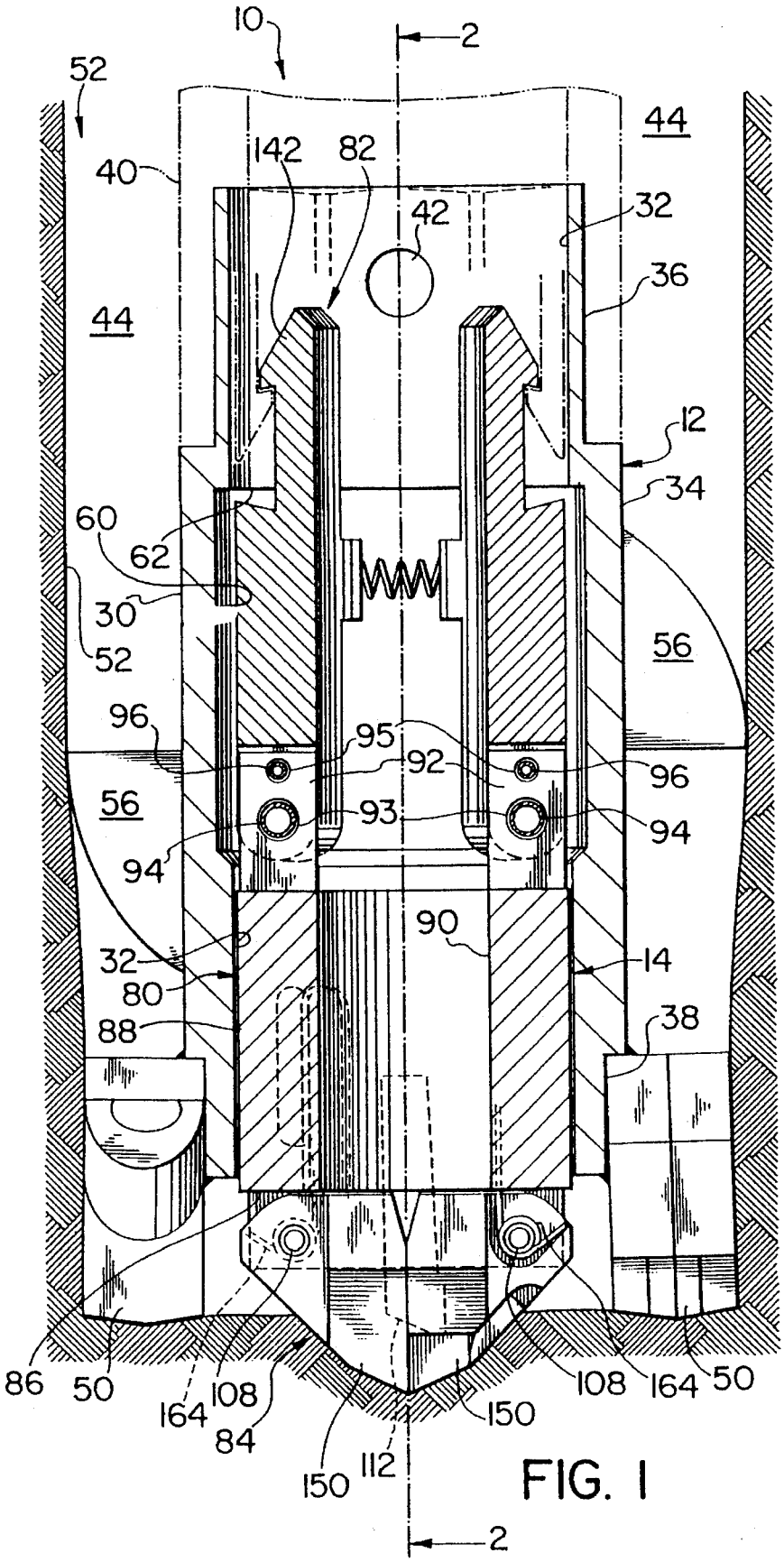
FIG. 1 is a longitudinal cross-sectional view taken through the cutting bit assembly according to a preferred embodiment of the present invention, in which the assembly is in the drilling position at the bottom of a borehole, the pilot bit latch mechanism is disengaged from the outer auger bit and engaged with a retrieval tool and the pilot bit closure means is in a drilling position.
Figure 2:
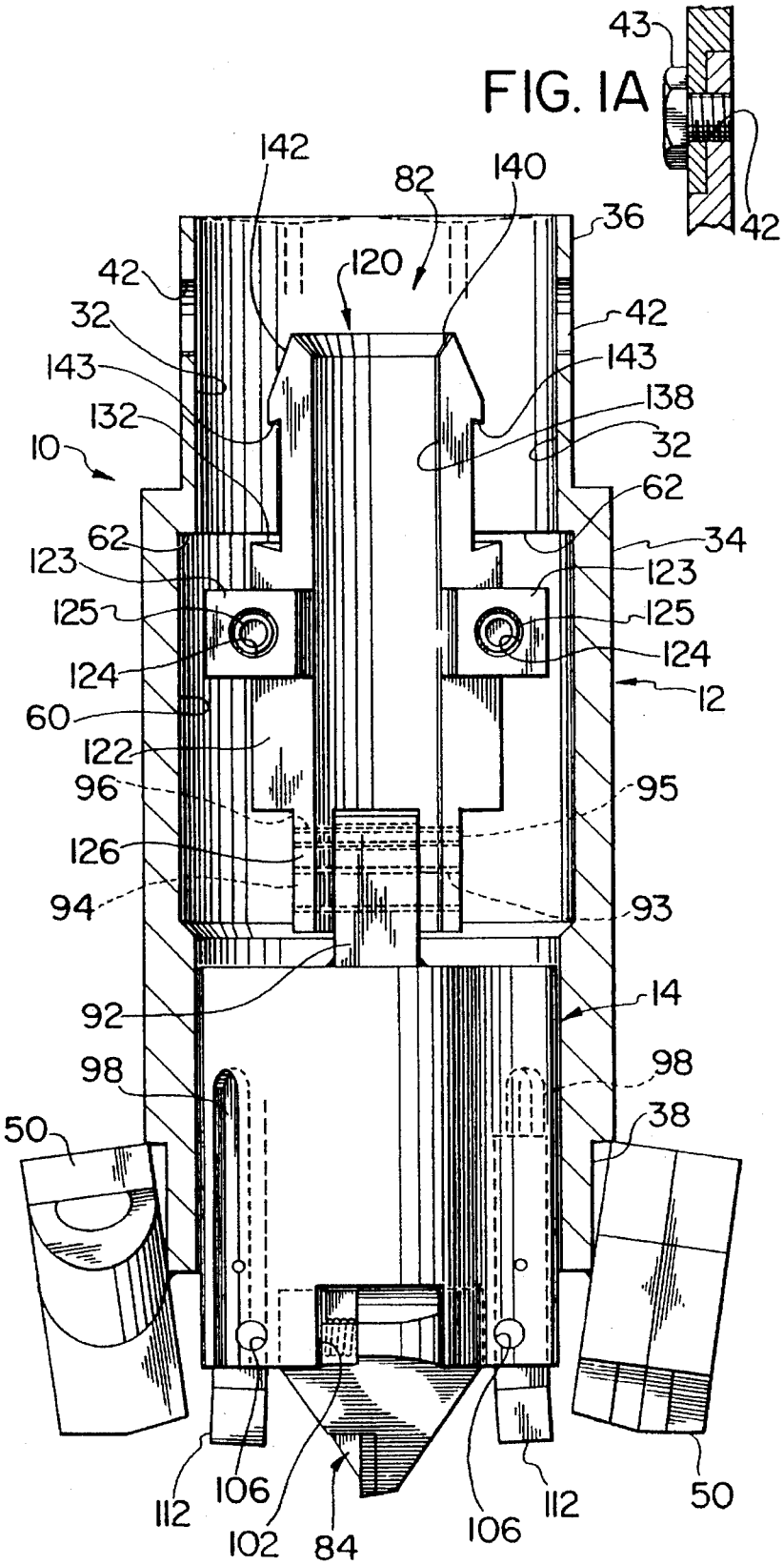
FIG. 2 is a partial, longitudinal cross-sectional view taken along lines 2—2 in FIG. 1, excluding the borehole and showing only a portion of the latch mechanism.
Figure 3:
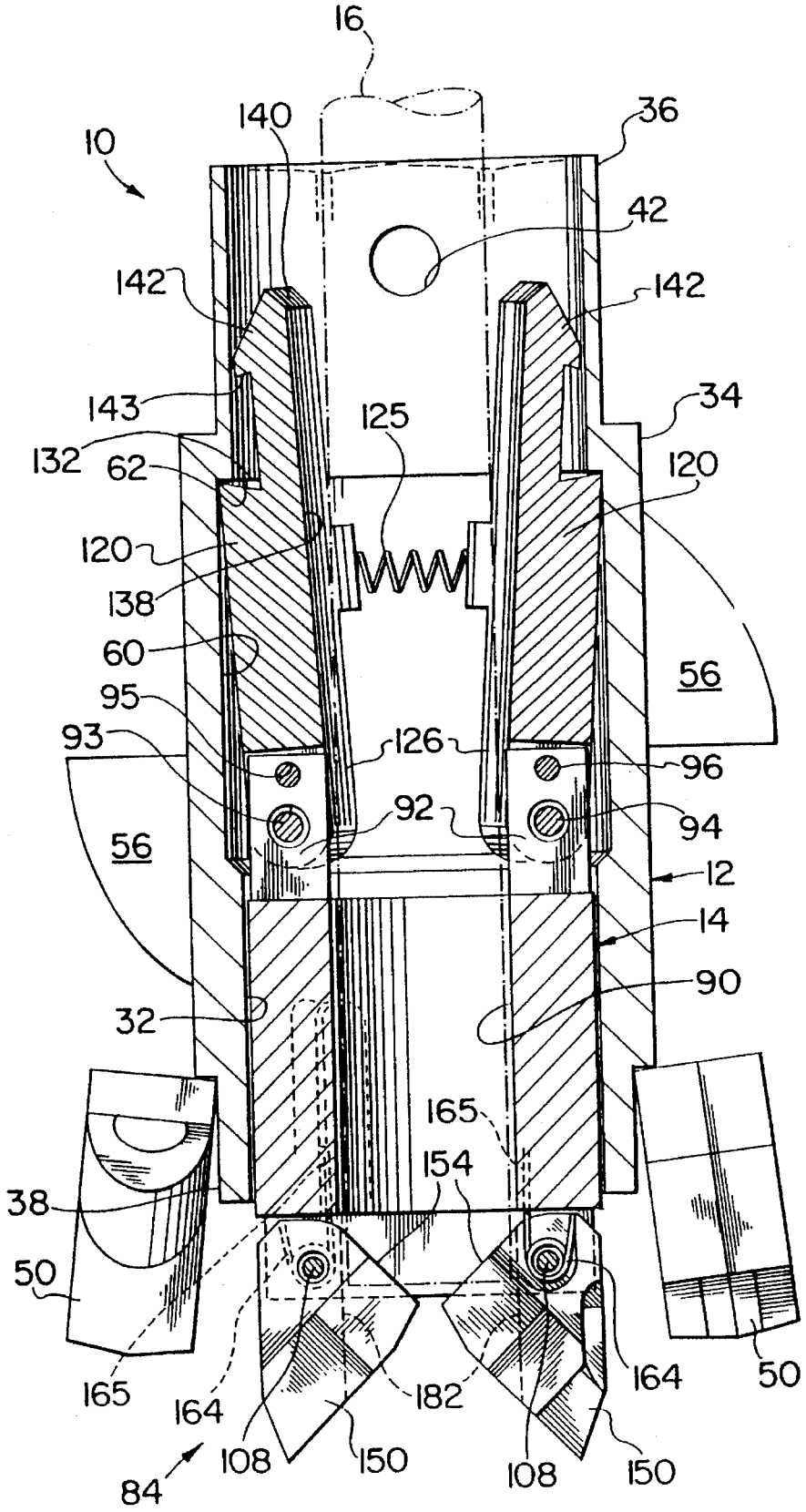
FIG. 3 is a longitudinal cross-sectional view, similar to that of FIG. 1, but illustrating the latch mechanism in an auger bit engaging position and a sampling tube telescopically inserted into and through the pilot bit and, thus, with the closure means in its opened position.

Reference will now be made to FIGS. 1–9 which illustrate a preferred embodiment of the auger bit assembly, generally designated by reference numeral 10, of the present invention.

By way of overview, the auger bit assembly is detachably secured to the bottom end of the lowermost pipe of a conventional drill string formed by drill pipe connected together in end-to-end relation. The auger bit assembly is formed with cutting teeth which are operable to cut a borehole into an earth formation as the drill string is rotated by a drive mechanism (not shown) located at the surface. The auger bit assembly comprises an outer auger bit 12 and an inner bit 14, hereinafter called the pilot bit. The pilot bit is telescopically received within the auger bit. A latch mechanism releasably secures the pilot bit to the auger bit against axial displacement. The latch mechanism can be disengaged from the auger bit by a retrieval tool which is lowered down the drill string on a wireline and engaged to the latch mechanism to permit the pilot bit to be extracted. The pilot bit is keyed to the auger bit for rotation with the auger bit. The pilot bit is formed with an axial throughbore sized to telescopically receive a sampling tube and it is provided a throughbore closure means to permit the sampling tube to pass through the pilot bit into the earth formation beyond while preventing formation heave into the auger bit assembly. The closure means is normally closed to seal the throughbore from formation heave and it is opened simply by pushing the sampling tube against it. Auger bit 12 will now be described in greater detail.

Auger Bit

With reference to FIGS. 1–4 and 7, the auger bit is in the form of a cylindrical tubular body 30 having a cylindrical bore 32 and an outer cylindrical surface 34 which is formed with reduced diameter portions 36 and 38 at its upper and lower ends, respectively. The outer surface of the upper reduced diameter portion 36 is octagonal in shape (see FIG. 7) for mating driving engagement with a similarly shaped socket in the bottom end of the lowermost drill pipe member 40 of the hollow drill string or stem. Aligned radial holes 42 in the upper reduced diameter portion 36 and in the socket portion of the drill pipe are provided to receive a bolt 43 (see FIG. 1*a*) to prevent axial displacement of the two components. It is to be understood that any mechanism may be used to rotatably and axially secure the auger bit to the drill pipe. The drill string is entirely conventional in construction and, accordingly, it is not described in detail herein.

Figure 4:
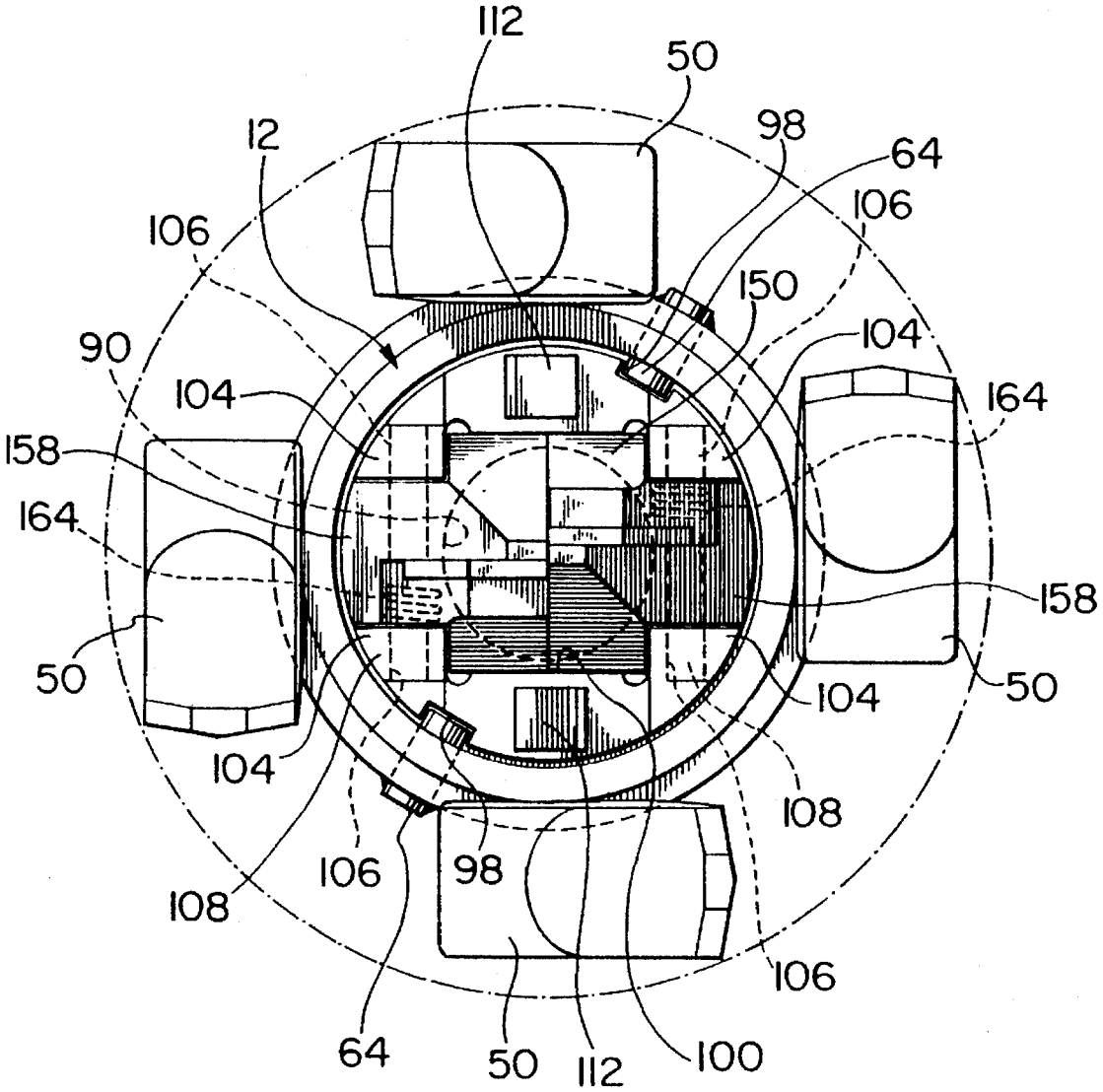
FIG. 4 is a bottom view of the auger bit assembly.

A plurality of cutting teeth 50, four are shown in FIG. 4, are secured by welding at equal angular intervals to the lower reduced diameter portion 38 of the auger bit and are operable, upon rotation of the auger bit, to cut an annular hole in the earth formation. The cutting teeth are entirely conventional in construction and, therefore, are not described in detail herein. It will be noted, however, that cutting teeth 50 extend radially outwardly beyond the outer diameter of the auger bit thus forming a borehole 52 in the earth formation and an annular space 44 through and along which cuttings are carried to the surface. For this purpose, auger flights 56 are secured to the outer surface of the auger bit and to the outer surface of drill pipes to which the auger bit is secured.

Bore 32 extends through the entire length of the auger bit and is interrupted only by a recessed section 60 which provides an annular, downwardly facing, bevelled shoulder 62. Shoulder 62 is provided to engage the latch mechanism, as described later, secured to pilot bit for holding the pilot bit against upward axial displacement during drilling. A pair of diametrically opposed, axially extending keys 64 extend into bore 32 for engagement with mating axially extending keyways formed in the outer surface of the pilot bit, as explained later, so as to rotatably, drivingly connect the auger bit and pilot bit. It will be understood that the number of keys and, indeed the mechanism used to connect the auger bit and pilot bit for rotation, may be varied according standard engineering practice.

Pilot Bit

Pilot bit 14 will now be described with reference to FIGS. 1–5, and 7. The pilot bit is generally comprised of three subassemblies, namely a pilot bit main body portion 80, a latch mechanism 82 secured to the upper end of main body 80 and closure means 84 secured to the bottom end or underside 86 of the main body. The underside 86 of the main body and the closure means are formed with cutting teeth, described later, for cutting into the earth formation within the annular borehole cut by the auger bit.

Figure 5:
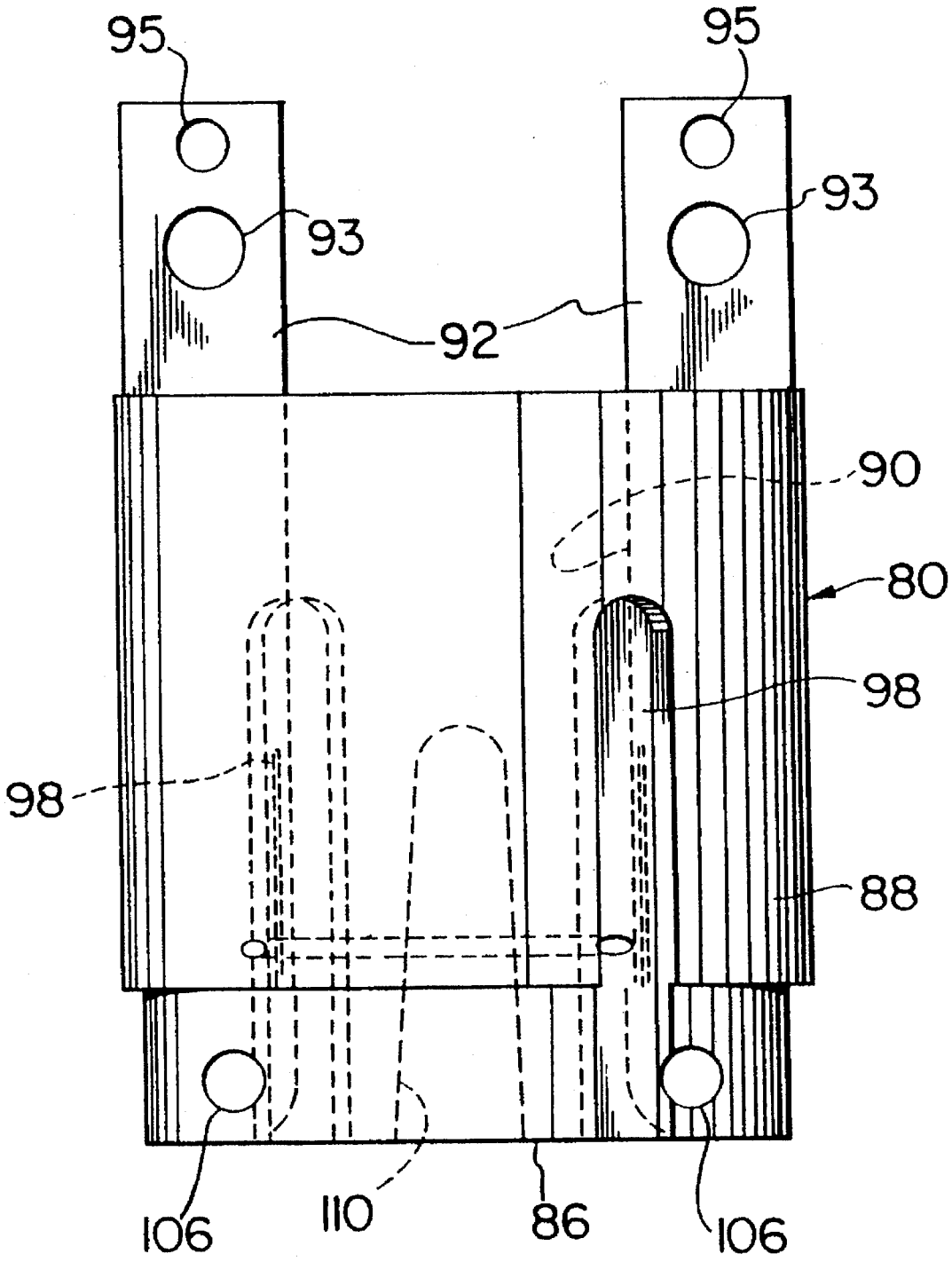
FIG. 5 is a side elevational view of the main body portion of the pilot bit illustrating upstanding lugs at the upper end for engagement with the latch mechanism, keyways in the outer cylindrical surface and holes in the bottom end for receiving closure means pivot pins.
Figure 7:
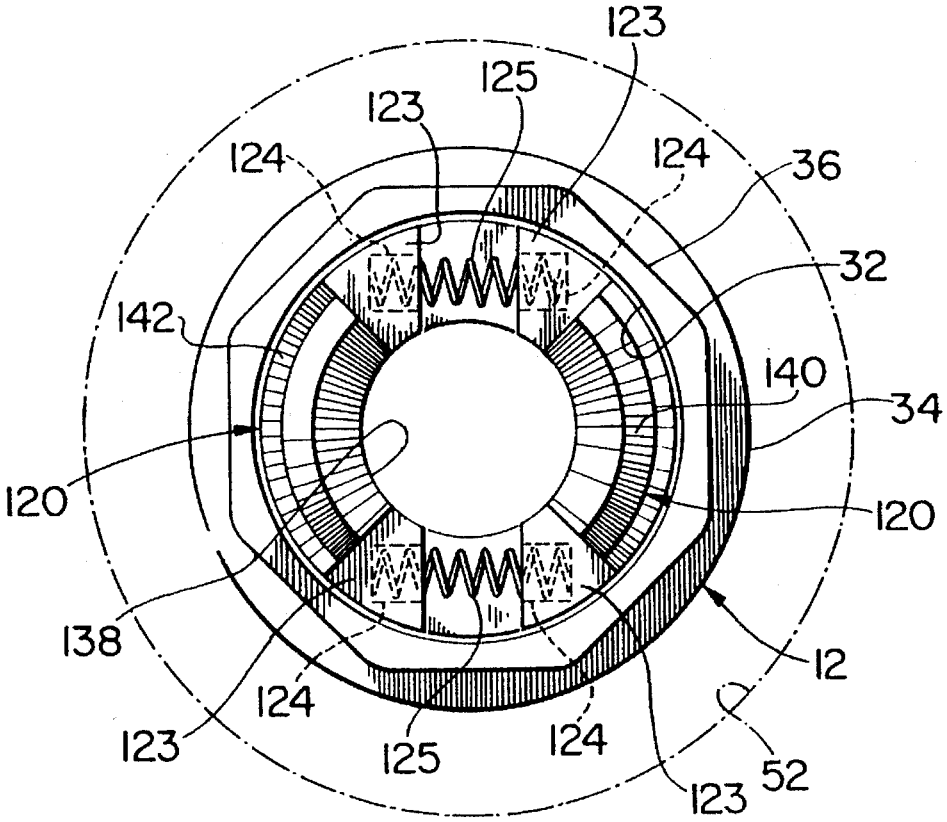
FIG. 7 is a top view of the auger bit assembly illustrated in FIG. 1, illustrating the octagonal shape of the reduced diameter portion of the auger bit, the inner bore of the auger bit, the throughbore of the pilot bit and the pair of opposed latching members.

As best shown in FIG. 5, pilot bit main body portion 80 is tubular and has an outer cylindrical surface 88 with a diameter which is slightly less than the diameter of bore 32 of the auger bit and an inner cylindrical throughbore 90 having a diameter which is slightly greater than the outer diameter of sampling tube 16 with which the pilot bit is intended to be used. The upper end of main body portion 80 is formed with two diametrically opposed upstanding lugs 92. A first hole 93 is drilled into each lug for receiving a spring pin 94 which serves as a latch pivot and a second smaller hole 95 is provided for receiving a spring pin 96. Hole 95 is somewhat larger than the diameter of spring pin 96 to permit required pivotal movement of the latch members, described later, about pin 94 during operation while keeping the latch members in position when the pilot bit is removed from the auger. The outer surface 88 of pilot bit main body portion 80 is formed with two diametrically opposed, axially extending keyways 98 which receive mating keys 64 which extend inwardly from bore 32 of the auger bit.

Figure 9:
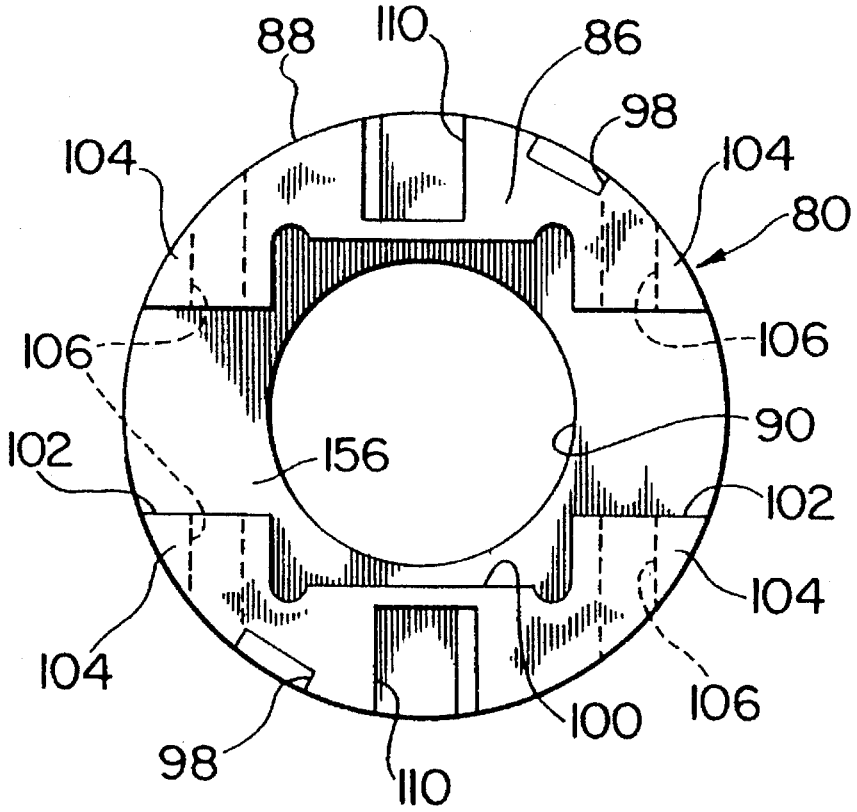
FIG. 9 is a bottom view of the pilot bit main body according to the preferred embodiment of the invention illustrating the throughbore and the square recess and radial channels for receiving the throughbore closure members.

With reference to FIG. 9, the underside of the main body portion of the pilot bit is formed with a centrally disposed square recess 100 from which extend a pair of radial channels 102 for receiving a portion of the closure means. Channels 102 define a pair of opposed pivot mounts 104. Aligned transverse holes 106 are drilled into the pivot mounts for receiving a pivot pin 108. The underside 86 of the main body is also formed with a pair of diametrically opposed, tapered, axial holes 110 for receiving additional cutter bits 112 (see FIG. 2). Bits 112 serve to overlap that portion of the borehole between that cut by the closure means cutters, described later, and the auger bit cutters. The additional cutter bits are of conventional construction and, therefore, are not described in detail herein. It will be understood that any suitable mechanism may be utilized to secured the additional cutter bits to the pilot bit body.

Latch Mechanism

Figure 8:
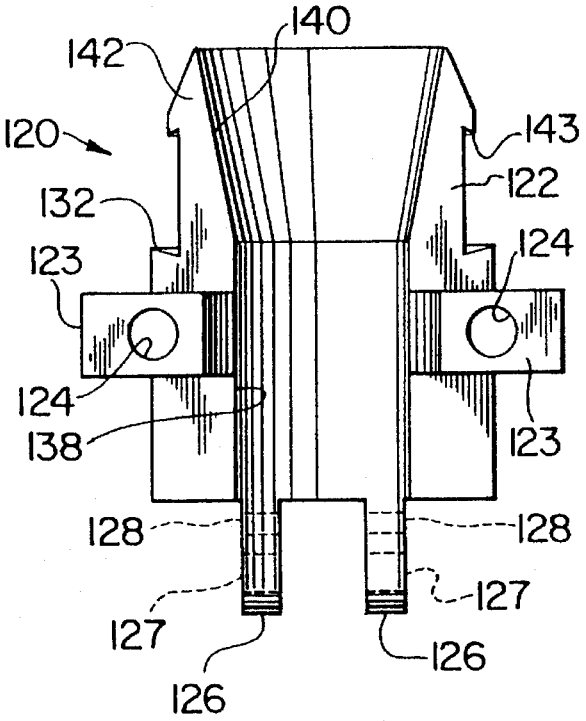
FIG. 8 is a elevational view of a latch member.

Latch mechanism 82 is comprised of two latch members 120 of identical construction. FIG. 8 illustrates one of the latch members. Each latch member includes a body 122 which is one segment of a tube which was pre-machined to shape and then longitudinally cut into four equal segments. A lug 123 is welded to each side of the latch member as shown. Blind hole 124 are drilled into the end of each lug to receive the end of a compression coil spring 125. When assembled, the lugs of one latch member face the lugs or the other latch member and springs 125 extend between and into the opposed blind holes so as to bias the latch members apart.

Body 122 includes at one end a bifurcated lug 126 having holes 127 and 128. Lug 126 straddles one of upstanding lugs 92 with holes 127 and 128 being aligned with holes 93 and 95. Pivot pin 94 passes through holes 93 and 128 and serves to both secure the latch member to the main body portion and permit the latch member to pivot about the axis of pin 94, which axis is perpendicular to the longitudinal axis of the pilot bit. Spring pin 96 extends through holes 95 and 127 to limit the angular travel of the latch members, as already mentioned.

Figure 11:
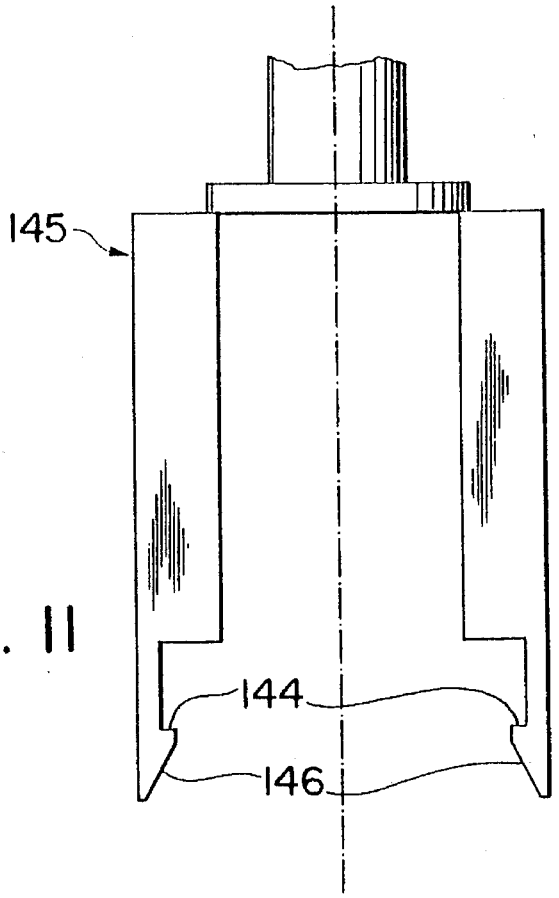
FIG. 11 is a side elevational view of a pilot bit retrieval tool.

Each latch member further includes an annular, upwardly facing shoulder 132 for engagement with annular shoulder 62 of the auger bit when the pilot bit is in its innermost position and the two latch members are urged apart by springs 125. It will be noted that the shoulders are tapered slightly so as to ensure that during drilling the two shoulders are urged into firmer engagement. The inner surfaces 138 of the latch members are cylindrical and sized to telescopically receive a sampling tube. The upper ends 140 of the inner surfaces are outwardly tapered slightly to facilitate entry of a sampling tube into the latching mechanism. The end of each latch member remote from bifurcated lug 126 is formed with an inwardly and upwardly tapered latch portion 142 having a downwardly facing shoulder 143 for engagement with an upwardly facing shoulder 144 of pilot bit retrieval tool 145 illustrated in FIG. 11. The outer tapered surface 146 serves to engage the retrieval tool and urge the two latch members radially inwardly toward one another against the action of springs 125, thereby disengaging shoulders 62 and 132.

Engagement between shoulders 62 and 132 and between the upper ends of keys 64 and the upper ends of their associated keyways 98 serves to define the innermost position of the pilot bit within the auger bit and to deliver to the pilot bit the load necessary to cut into the earth formation.

Closure Means

Generally, the closure means 84 is secured to the end of the pilot bit body remote from the latch mechanism and is movable between a normally closed position in which the closure means serves to close pilot bit throughbore 90 to prevent cuttings from entering the throughbore and an opened position when it is acted upon by the sampling tube from the interior of the pilot bit. The closure means is provided with cutting teeth for cutting a circular hole in the formation concentric with and within the annular borehole cut by the teeth on the auger bit. The throughbore closure is resiliently urged toward its normally closed position.

With reference to FIGS. 4, 5, 6*a*, 6*b*, 6*c* and 6*d*, the preferred embodiment of closure means 84 comprises a pair of opposed closure members 150 which are of identical construction. Each closure member includes a unitary closure member body 152 having a base surface 154 which is abuttingly engageable with base surface or floor 156 of square recess 100 on the underside of pilot bit body 80. A hinge portion 158 having a hole 160 for receiving pivot pin 108 is formed at one end of closure member body 152. Hinge portion 158 is received in snug fit relation within one of radial channels 102 extending from recess 100 with hole 160 axially aligned with holes 106. A concentric, recess 162 is formed in body 152 about hole 160 for receiving a torsion spring 164 which resiliently urges closure body 152 to its closed position. A recess and spring may be provided at both ends of the hinge portion if additional closing effort is required. One end of the torsion spring bears against closure body 152 while the other end of the spring is inserted into a longitudinal hole 165 drilled into pilot bit main body 80.

The other end of body 152 is formed with a fiat or planar surface 166 which abuttingly engages the corresponding surface of the other closure member when the two members are in their respective dosed positions. As best shown in FIG. 4, in the closed positions of the closure members, the base portions of the closure members are disposed within the square recess 100 and completely close the downhole or bottom end of throughbore 90, thus substantially completely preventing ingress thereinto of any cuttings.

Opposed sides 170 and end 172, remote from planar surface 166, taper inwardly toward the axis of throughbore 90 so as to ensure that the pilot bit can be extracted with the closure members in their respective opened positions (see FIG. 3) in the event that it is necessary to do so. The closure members are formed with recesses 174 and 176 for receiving replaceable carbide cutting teeth inserts 178 and 180, respectively. The inserts are secured to the closure body by silver soldering.

Figure 6A:
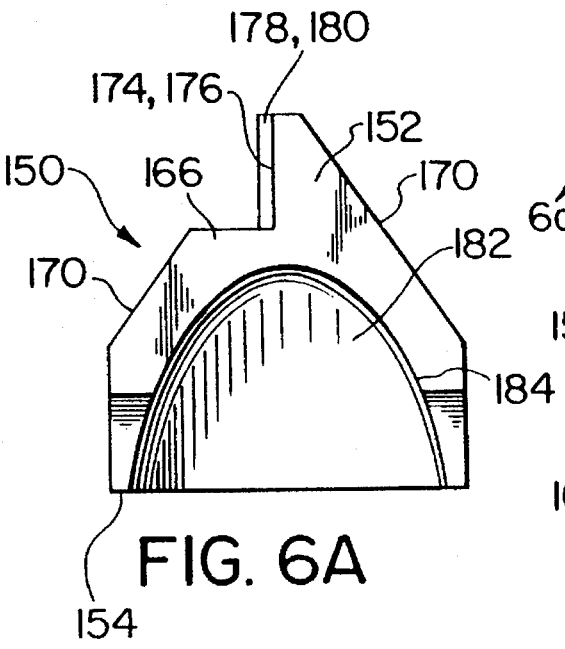
FIG. 6*a* is a front elevational view of a closure member according to the preferred embodiment of the present invention.
Figure 6B:
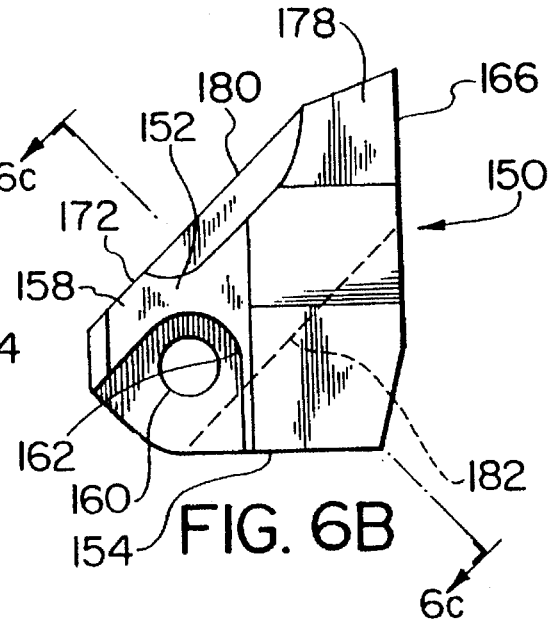
FIG. 6*b* is a side elevational-view of the closure member illustrated in FIG. 6*a;*
Figure 6C:
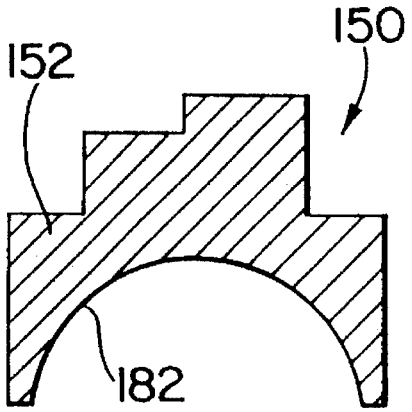
FIG. 6*c* is a cross-sectional view of the closure taken along line 6*c*—6*c* of FIG. 6*b;*
Figure 6D:
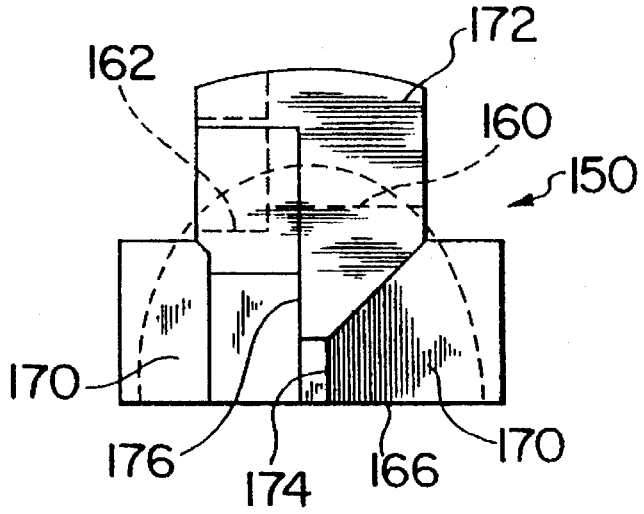
FIG. 6*d* is a plan view of the closure member illustrated in FIG. 6*a*.

The inner side of each closure member is formed with a cylindrical recess 182, best shown in FIG. 6*c*, the axis of which in the closed position of the closure member is inclined downwardly and inwardly and, in the opened position thereof is substantially parallel with the axis of the throughbore of the pilot bit. The radius of cylindrical recess 182 is substantially the same as that of the throughbore so that, in their opened positions, the two recesses form an extension of the throughbore. Recesses 182 each define an edge 184 which engages the outer surface of the sampling tube and serve to remove any material adhered to the sampling tube as the tube is extracted from the borehole and, thus, prevent cuttings from entering into the throughbore.

While the preferred embodiment of the invention involves a two-piece pivoted closure means, it is to be understood that the inventive concept is to allow a sampling device to pass through the pilot bit. Accordingly, the above described and illustrated closure means is the preferred embodiment of the invention, the inventors contemplate other methods and mechanisms including, for example, an "iris" mechanism, such as in a camera, vertically pivoted arms which would swing sideways to let the sampling device pass through the pilot bit and so forth.

Figure 10:
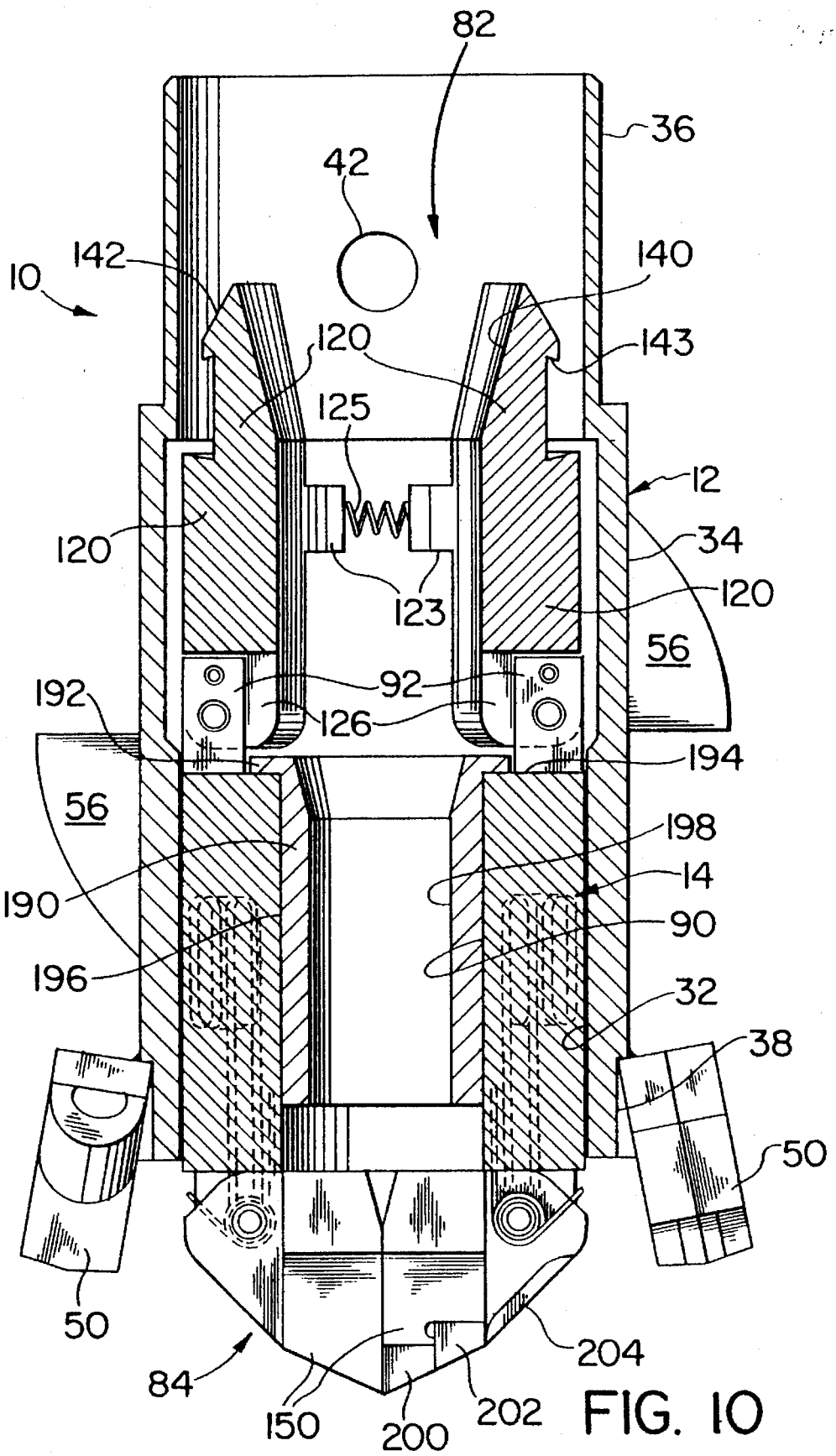
FIG. 10 is a longitudinal cross-sectional view according to another embodiment of the present invention in which there is provided a bushing in the pilot bit for accommodating sampling tubes of smaller diameter than the sampling tube diameter for which the pilot bit was originally designed.

FIG. 10 illustrates another embodiment of the invention which is substantially the same as that of FIGS. 1–9, except for the inclusion of a tubular sampling tube centralizing bushing 190 within the pilot bit. Accordingly, like reference numerals designate like parts. Bushing 190 would be used in an auger bit assembly which was designed for use of a sampling tube of one size but where it is desired to use a smaller sampling tube. The bushing is formed with a radially outwardly extending flange 192 which sits upon upper annular surface 194 of the pilot bit, an outer cylindrical surface 196 received in throughbore 90 and an inner cylindrical bore 198. Bore 198, like throughbore 90 of the embodiment of FIGS. 1–9, is dimensioned to be slightly larger than the diameter of the sampling tube which is to be employed. The upper end of bore 198 is tapered to facilitate insertion of the sampling tube into the bushing. It will be understood from FIG. 10 that the bushing would require installation before the latch members. The closure members are each provided with three replaceable carbide cutters 200, 202 and 204, as shown. However, it is to be understood that the number, shape and design of the cutters and the method of affixing them to the closure may be modified without departing from the spirit of the invention.

The operation of the present invention is believed to be self-explanatory from the foregoing. Before beginning a drilling operation, the pilot bit is introduced into and seated within the auger bit where the inner upper ends of keys 64 engage the inner ends of keyways 98 and shoulder 62 of the auger bit and shoulders 132 of the latch members are engaged under the action of compression coil spring 125. The auger bit is then secured to the bottom end of a drill pipe, the drill pipe is connected to the drilling mechanism and drilling is started. It will be understood that the closure members 150 will be in their respective closed positions. During drilling, the auger bit cutters cut the outer portion of the borehole, the closure bit cutters cut in the inner portion of the borehole and the additional cutters cut the portion of the borehole between the inner and outer cut portions.

When it is desired to take a sample, the drill stem is raised a sufficient distance to permit the closure members to open, later, without interference by the bottom of the borehole. The closure members remain closed under the action of springs 164. A sampling tool is then inserted into the drill pipe in the conventional manner. When the sampling tube reaches the auger bit assembly, it will first engage the tapered upper ends of the inner arcuate surfaces of the latch members 120 so as to concentrically aligned the sampling tube with the auger bit assembly. As the sampling tube continues to be lowered, it will pass through the latch mechanism and enter throughbore 90 of the pilot bit and, ultimately, reach and engage cylindrical recesses 182 of closed closure members and then opens the closure members against the action of springs 164. As the closure members open, any material which might be lodged between the edges of the closure members and the bottom of the pilot bit will loosen and fall away, so that there should be little to prevent the closure members from returning to their closed position when the sampling tube is removed.

As the sampling tube progresses downwardly, edges 184 of the closure member engage and wipe the outer surface of the sampling tube and prevent ingress of cuttings into the auger bit assembly. Once the sampling tube has fully penetrated the closure members, the axes of recesses 182 will be substantially parallel to the axis of the sampling tube and held intimately against the sampling tube by springs 164. Once the sampling tube has been pushed a sufficient distance into the earth formation, it is pulled upwardly. As the tube moves upwardly, edges 184 continue to engage the outer surface of the tube so as to, again, wipe material from the outer surface of tube. Material is also prevented from entering the auger bit assembly by the close fit between the sampling tube and throughbore 90. When the bottom end of the sampling tube moves into the pilot bit, springs 164 will close closure members 150. The sampling tube then exits throughbore 90 and the latch mechanism and is pulled back up to the surface. The drill stem is lowered and drilling is resumed. Clearly, sampling according to the present invention is considerably simply and faster than the traditional method described earlier.

When the borehole has been completed and it is desired to remove the pilot bit, the retrieval tool is simply lowered down the drill pipe by wireline until it disengages the latch members from the auger bit and it itself engages the latch mechanism in the manner explained earlier.

It will be understood that various modifications and alterations may be made to the present invention without departing from the spirit of the appended claims.

The embodiments of the invention in which an exclusive property of privilege is claimed are defined as follows:

1. A pilot bit for use with an auger in an auger bit assembly secured to the downhole end of tubular drill stem for drilling boreholes in earth formations, said pilot bit comprising:

a tubular pilot bit body having a downhole end and an upper end at the axially opposite end of said body, said body being dimensioned to be telescopically received within an axial bore of an auger bit and being releasably connectable to said auger bit against axial and angular displacement;

a axial throughbore extending through said body for telescopically receiving an earth sampling tool; and closure means secured to said downhole end of said pilot bit for opening and closing the downhole end of said throughbore, pilot bit cutting teeth secured to said closure means, said closure means being movable between an open position removed from said throughbore to permit passage of a sampling tool through said pilot bit into an earth formation and a closed position whereat said closure means closes said downhole end of said throughbore and said pilot bit cutting teeth are disposed for cutting into an earth formation upon rotation of said pilot bit.

2. A pilot bit as defined in claim 1, said closure means comprising a plurality of opposed closure members, each said closure member being secured to said downhole end of said pilot bit for pivotal movement between said opened and said closed positions about an axis extending transversely of said throughbore, said closure members being abuttingly engageable against one another in said closed position of said closure means.

3. A pilot bit as defined in claim 2, further including means for biasing said closure members toward said closed position.

4. An auger bit assembly for use in drilling boreholes in earth formations, said assembly comprising, in combination:

an auger bit having a tubular body having a downhole end and an upper end remote said downhole end, auger means on the outer side of said auger body for longitudinally conveying cuttings upwardly of a borehole hole, an axial passageway extending through said auger body, cutting teeth at said downhole end of said auger body for cutting an annular hole upon rotation of said auger bit, and means for securing said auger bit to a drill stem for rotation therewith; and a pilot bit having a tubular body having a downhole end and an upper end remote from said downhole end and dimensioned to be telescopically received in said auger bit axial passageway in sliding fit relation, a throughbore extending axially through said pilot bit body for telescopically receiving an earth sampling tool, closure means secured to said downhole end of said pilot bit for opening and closing said throughbore, pilot bit cutting teeth secured to said closure means, said closure means being movable between a closed position whereat said closure means closes the downhole end of said throughbore and said pilot bit cutting teeth are disposed for cutting into an earth formation upon rotation of said pilot bit and an open position removed from said throughbore to permit passage of a sampling tool through said pilot bit into an earth formation.

5. An auger bit assembly as defined in claim 4, said closure means comprising a plurality of opposed closure members, each said closure member being secured to said downhole end of said pilot bit for pivotal movement about an axis extending transversely of said throughbore between said opened position and said closed position, said closure members being abuttingly engageable against one another in said closed position of said closure means.

6. An auger bit assembly as defined in claim 5, further including means for biasing said closure members toward said closed position.

7. An auger bit assembly as defined in claim 5, each said closure member including a closure body having:

a hinge portion at one end for securing said closure member body to said pilot bit;

a bearing surface at an end of closure body remote from said hinge portion, said bearing surface being abuttingly engageable, in said closed position of said closure means, with a mating bearing surface of one or more other closure members secured to said pilot bit;

a channel in said closure body, said channel having substantially the same cross-sectional shape as that of said throughbore such that, in said opened position of said closure member, said channel forms an axial extension of said throughbore, said channel terminating at an edge operable to slidingly engage the outer surface of a sampling tool for removing therefrom adhered material as said tool is extracted from said pilot bit; and means for receiving at least one cutting tooth.

8. An auger bit assembly as defined in claim 7, said auger bit passageway having a downwardly facing annular shoulder, said pilot bit further including latch means extending from said upper end thereof, said latch means having an upwardly facing annular shoulder and being radially movable between an outer engaged position whereat said upwardly facing annular shoulder engages said downwardly facing annular shoulder to prevent axial upwardly displacement of said pilot bit with respect to said auger bit and a retracted, disengaged position whereat said shoulders are disengaged and said pilot bit is free to move axially with respect to said auger bit.

9. An auger bit assembly as defined in claim 8, further including means for resiliently urging said latch means toward said engaged position.

10. An auger bit assembly as defined in claim 8, further including key means received in said pilot bit and said auger bit for securing said pilot bit to said auger bit for rotation therewith.

11. An auger bit assembly as defined in claim 8, further including centralizing bushing means telescopically insertable into said throughbore for accommodating smaller sampling tubes.

12. An auger bit assembly as defined in claim 4, said pilot bit being releasably engageable with said auger bit to prevent axial displacement of said pilot bit with respect to said auger bit.

13. An auger bit assembly as defined in claim 4, said pilot bit being releasably engageable with said auger bit for rotation therewith.

* * * * *